US011336059B2

(12) United States Patent
Duan et al.

(10) Patent No.: US 11,336,059 B2
(45) Date of Patent: May 17, 2022

(54) SHIELD SHELL WITH DIVIDERS BETWEEN ELECTRICAL CONNECTORS

(71) Applicant: DONGGUAN LUXSHARE TECHNOLOGIES CO., LTD, Dongguan (CN)

(72) Inventors: Baiyu Duan, Dongguan (CN); Zhen Luo, Dongguan (CN); Tiesheng Li, Dongguan (CN)

(73) Assignee: DONGGUAN LUXSHARE TECHNOLOGIES CO., LTD., Dongguan (CN)

( * ) Notice: Subject to any disclaimer, the term of this patent is extended or adjusted under 35 U.S.C. 154(b) by 13 days.

(21) Appl. No.: 16/951,405

(22) Filed: Nov. 18, 2020

(65) Prior Publication Data

US 2022/0045462 A1 Feb. 10, 2022

(30) Foreign Application Priority Data

Aug. 6, 2020 (CN) ..... 202021620094.X

(51) Int. Cl.
*H01R 13/6582* (2011.01)
*H01R 13/6586* (2011.01)
(Continued)

(52) U.S. Cl.
CPC ..... *H01R 13/6582* (2013.01); *H01R 13/518* (2013.01); *H01R 13/6586* (2013.01);
(Continued)

(58) Field of Classification Search
CPC ..... H01R 13/6582; H01R 13/518; H01R 13/6586; H01R 13/658; H01R 13/6581; H01R 13/6583; H01R 13/659
See application file for complete search history.

(56) References Cited

U.S. PATENT DOCUMENTS

2020/0153170 A1* 5/2020 Wei ..... H01R 13/6592

FOREIGN PATENT DOCUMENTS

CN 205621959 U 10/2016
CN 205752808 U 11/2016

* cited by examiner

*Primary Examiner* — Abdullah A Riyami
*Assistant Examiner* — Justin M Kratt
(74) *Attorney, Agent, or Firm* — Birch, Stewart, Kolasch & Birch, LLP

(57) ABSTRACT

A connector includes a shield. The shield includes a shell, a divider plate and anti-electromagnetic-interference elastic sheets. The shell are provided with first limit holes. Anti-electromagnetic-interference elastic sheets on the divider plate are first anti-electromagnetic-interference elastic sheets. A plurality of the first positioning sheets extend from each metal sheet of each first anti-electromagnetic-interference elastic sheet. Each first positioning sheets is guided through a respective first limit hole and abuts against a respective one of the walls of the shell. Positioning sheet Anti-electromagnetic-interference elastic sheets disposed on the walls of the shell are second anti-electromagnetic-interference elastic sheets. A second positioning sheet extends from one of the two metal sheets of each second anti-electromagnetic-interference elastic sheet. Second limit holes are disposed on the walls of the shell. Each second positioning sheet is guided through a respective second limit hole and abuts against a respective wall of the shell.

20 Claims, 6 Drawing Sheets

(51) Int. Cl.

| | |
|---|---|
| ***H01R 13/518*** | (2006.01) |
| *H01R 13/6581* | (2011.01) |
| *H01R 13/659* | (2011.01) |
| *H01R 13/6583* | (2011.01) |
| *H01R 13/658* | (2011.01) |

(52) U.S. Cl.
CPC ..... *H01R 13/658* (2013.01); *H01R 13/659* (2013.01); *H01R 13/6581* (2013.01); *H01R 13/6583* (2013.01)

SHIELD SHELL WITH DIVIDERS BETWEEN ELECTRICAL CONNECTORS

CROSS-REFERENCE TO RELATED APPLICATION(S)

This application claims priority to Chinese Patent Application No. 202021620094.X filed on Aug. 6, 2020, the disclosure of which is incorporated herein by reference in its entirety.

TECHNICAL FIELD

The disclosure relates to the field of connectors and, in particular, to a shield and a connector.

BACKGROUND

In the related art, a shield applicable to a connector generally includes a shell and at least one divider plate disposed in the shell. The at least one divider plate divides the inside of the shell into a plurality of ports. An anti-electromagnetic-interference elastic sheet is mounted on each of the four side walls of each of the ports to prevent other components from causing electromagnetic interference to signal terminals inside the ports. The anti-electromagnetic-interference elastic sheets secured in a related way easily fall off the shell so that signal transmission is affected.

SUMMARY

The disclosure provides a shield so that the anti-electromagnetic-interference elastic sheets can be reliably secured.

The disclosure further provides a connector to ensure the shielding effect of the shield and to improve the capability of the connector to resist signal interference.

The disclosure adopts the solution below.

A shield includes a shell, a divider plate and anti-electromagnetic-interference elastic sheets. The divider plate is disposed in the shell. The upper end and the lower end of each of the divider plates are connected to the top wall and the bottom wall of the shell respectively. The inner walls of the divider plate and the inner walls of the shell form a plurality of ports. Each of the four walls of each of the plurality of the ports is provided with a respective one of the anti-electromagnetic-interference elastic sheets. Each of the anti-electromagnetic-interference elastic sheets includes two metal sheets that are opposite to each other and that are connected to each other at one end of the two metal sheets.

Anti-electromagnetic-interference elastic sheets on the divider plate are first anti-electromagnetic-interference elastic sheets. First limit holes are disposed on the top wall and the bottom wall of the shell. A plurality of first positioning sheets extend from the upper end and the lower end of each of the metal sheets of each of the first anti-electromagnetic-interference elastic sheets. Each of the first positioning sheets is guided through a respective one of the first limit holes and abuts against a respective one of the walls of the shell. The first positioning sheets at the same end of each of the first anti-electromagnetic-interference elastic sheets are spaced apart and extend in opposite directions.

Anti-electromagnetic-interference elastic sheets disposed on the walls of the shell are second anti-electromagnetic-interference elastic sheets. A second positioning sheet extends from a respective one of the two metal sheets of each of the second anti-electromagnetic-interference elastic sheets. Second limit holes are disposed on the walls of the shell. Each of the second positioning sheets is guided through a respective one of the second limit holes and abuts against a respective one of the walls of the shell.

A connector includes the preceding shield.

REFERENCE LIST

Figure 1:
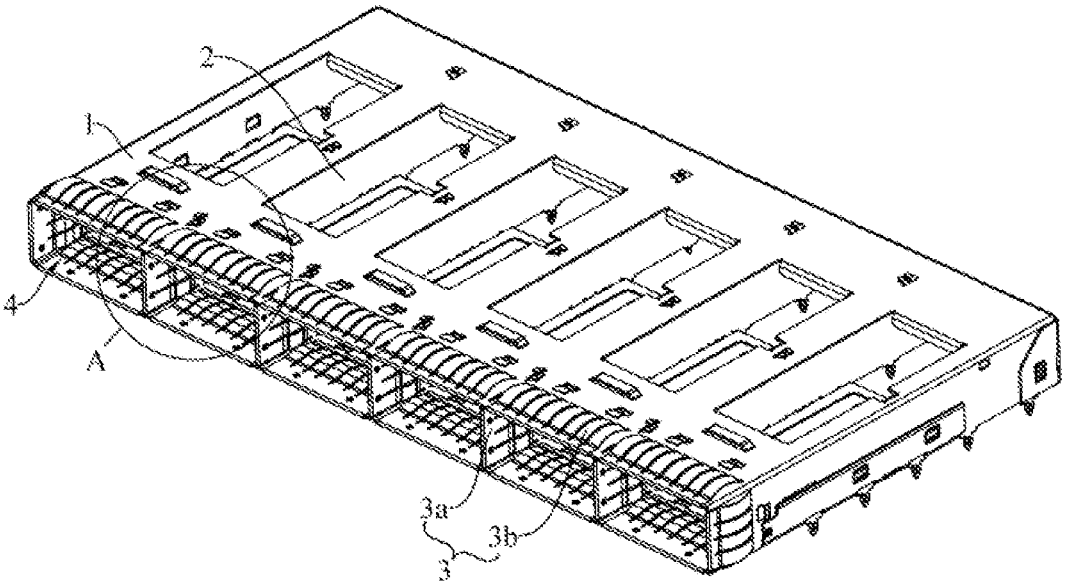
FIG. 1 is a perspective view of a shield according to an embodiment of the disclosure.

1 shell
11 upper shell
111 snap slot
112 snap
12 lower shell
121 block
122 engagement hole
13 first limit hole
14 second limit hole
15 second positioning hole
16 third positioning hole
17 first latching hole
2 divider plate
21 first latching protrusion
22 third positioning sheet
23 first positioning hole
3 anti-electromagnetic-interference elastic sheet
3*a* first anti-electromagnetic-interference elastic sheet
3*b* second anti-electromagnetic-interference elastic sheet
31 metal sheet
311*a* first protrusion
311*b* second protrusion
32*a* first positioning sheet
32*b* second positioning sheet
33*b* ledge
4 port

DETAILED DESCRIPTION

In the description of the disclosure, it is to be noted that orientation or positional relationships indicated by terms such as "center", "above", "below", "left", "right", "vertical", "horizontal", "inner" and "outer" are based on orientation or positional relationships shown in the drawings, merely for facilitating and simplifying the description of the disclosure, and these relationships do not indicate or imply that the device or element referred to must have a particular orientation, or be constructed and operated in a particular orientation, and therefore these relationships should not be construed as limiting the disclosure. In addition, terms such as "first" and "second" are merely used for description and cannot be construed as indicating or implying relative importance. The terms "first position" and "second position" refer to two different positions.

Unless otherwise specified and limited, the terms "mounted", "connection" "connected" and "secured" should be construed in a broad sense, for example, may be construed as a secured connection or a detachable connection; a mechanical connection or an electrical connection; a direct connection or an indirect connection through an intermediate medium; or a connection between interiors of two elements, or an interactional relationship between the two elements. For those skilled in the art, the meanings of the preceding terms in the disclosure can be understood according to cases.

Unless otherwise expressly specified and limited, when a first feature is described as "on" or "below" a second feature, the first feature and the second feature may be in direct contact or may be in contact via another feature between the two features instead of being in direct contact. In addition, that the first feature is "on", "above" or "over" the second feature includes that the first feature is right above or obliquely above the second feature or just indicates that the horizontal level of the first feature is higher than the horizontal level of the second feature. That the first feature is "under", "below" or "beneath" the second feature includes that the first feature is right below or obliquely below the second feature or just indicates that the horizontal level of the first feature is lower than the horizontal level of the second feature.

The following is a description of the solution of the disclosure in conjunction with FIGS. 1 to 10 and an embodiment.

The embodiment provides a connector including a shield. Referring to FIGS. 1 to 6, the shield includes a shell 1, divider plates 2 and anti-electromagnetic-interference elastic sheets 3. The divider plates 2 are disposed in the shell 1. The upper end and the lower end of each of the divider plates 2 are connected to the top wall and the bottom wall of the shell 1 respectively. The inner walls of the divider plates 2 and the inner walls of the shell 1 form a plurality of ports 4. Each of the four walls of each of the plurality of the ports 4 is provided with a respective one of the anti-electromagnetic-interference elastic sheets 3, and each of the anti-electromagnetic-interference elastic sheets 3 includes two metal sheets 31 that are opposite to each other and that are connected to each other at one end of the two metal sheets 31. Optionally, the shell 1 is a cuboid provided with an opening at one end, the divider plates 2 are disposed at the opening end of the shell 1, a plurality of divider plates 2 are arranged, the divider plates 2 are spaced apart in the longitudinal direction of the shell 1, and the two metal sheets 31 are disposed on the two sides of a divider plate 2 or on the two sides of a wall of the shell 1.

Figure 2:
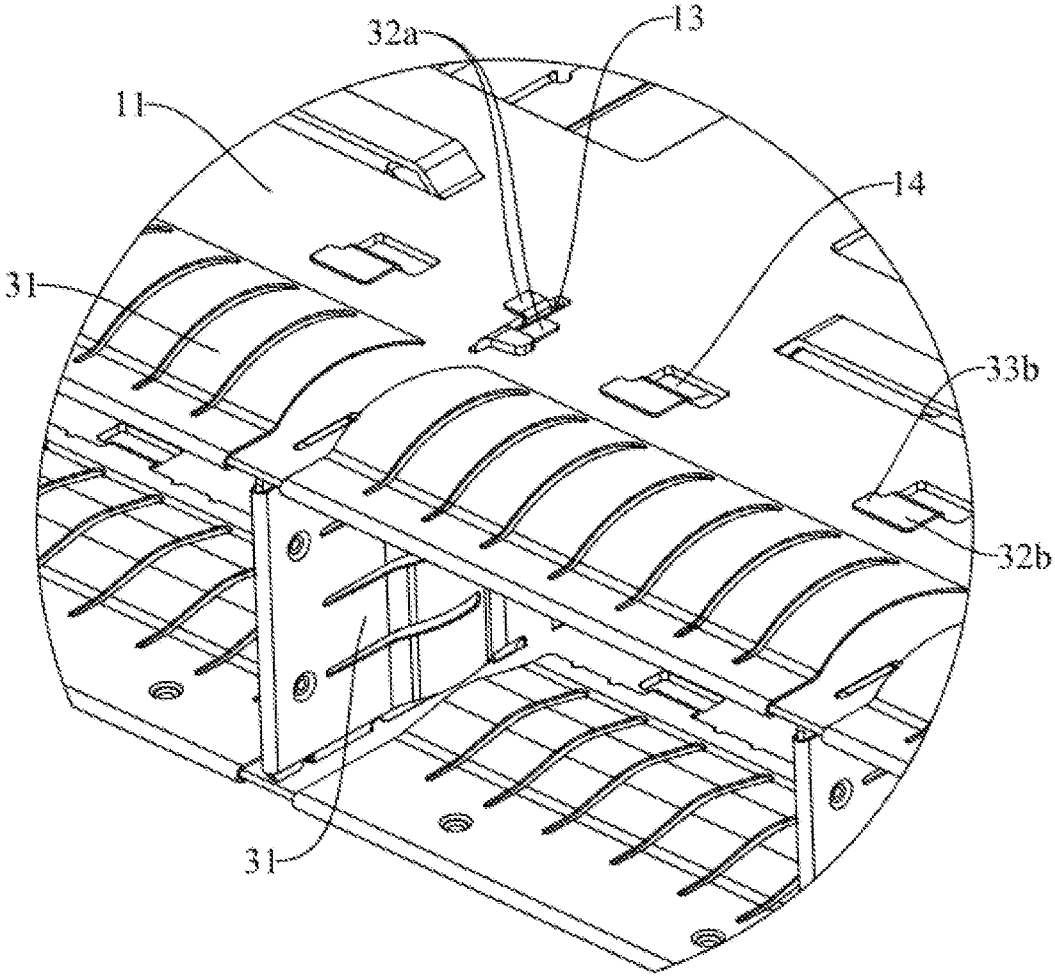
FIG. 2 is an enlarged view of part A of FIG. 1.

Referring to FIGS. 1 and 2, anti-electromagnetic-interference elastic sheets 3 on the divider plates 2 are first anti-electromagnetic-interference elastic sheets 3*a*. First limit holes 13 are disposed on the top wall and the bottom wall of the shell 1. A plurality of first positioning sheets 32*a* extend from the upper end and the lower end of each of the metal sheets 31 of each of the first anti-electromagnetic-interference elastic sheets 3*a*. Each of the first positioning sheets 32*a* is guided through a respective one of the first limit holes 13 and abuts against a respective one of the walls of the shell 1. The first positioning sheets 32*a* at the same end of each of the first anti-electromagnetic-interference elastic sheets 3*a* are spaced apart and extend in opposite directions so that the first positioning sheets 32*a* can be prevented from coming out of the first limit holes 13, the first anti-electromagnetic-interference elastic sheets 3*a* are prevented from falling off, and the reliability of the connection through the first anti-electromagnetic-interference elastic sheet 3*a* is improved.

Referring to FIGS. 1 and 2, anti-electromagnetic-interference elastic sheets 3 disposed on the walls of the shell 1 are second anti-electromagnetic-interference elastic sheets 3*b*. A second positioning sheet 32*b* extends from a respective one of the two metal sheets 31 of each of the second anti-electromagnetic-interference elastic sheets 3*b*. The second limit holes 14 are disposed on the walls of the shell 1. Each of the second positioning sheets 32*b* is guided through a respective one of the second limit holes 14 and abuts against a respective one of the walls of the shell 1 so that the anti-electromagnetic-interference elastic sheets 3*b* are prevented from falling off and the reliability of the connection through the second anti-electromagnetic-interference elastic sheets 3*b* is improved.

In the embodiment, after the first anti-electromagnetic-interference elastic sheets 3*a* are mounted on the divider plates 2, the first positioning sheet 32*a* may be riveted to abut against the walls of the shell 1. After the second anti-electromagnetic-interference elastic sheets 3*b* are mounted on the shell 1, the second positioning sheets 32*b* may be riveted to abut against the walls of the shell 1. The first positioning sheets 32*a* and the second positioning sheets 32*b* enable the anti-electromagnetic-interference elastic sheets 3 to be secured to the divider plates 2 or the shell 1.

Referring to FIG. 2, the first positioning sheets 32*a* at the same end of each of the first anti-electromagnetic-interference elastic sheets 3*a* are staggered. The first anti-electromagnetic-interference elastic sheet 3*a* is secured at different positions to improve the reliability of the connection through the first anti-electromagnetic-interference elastic sheet 3*a*.

Figure 3:
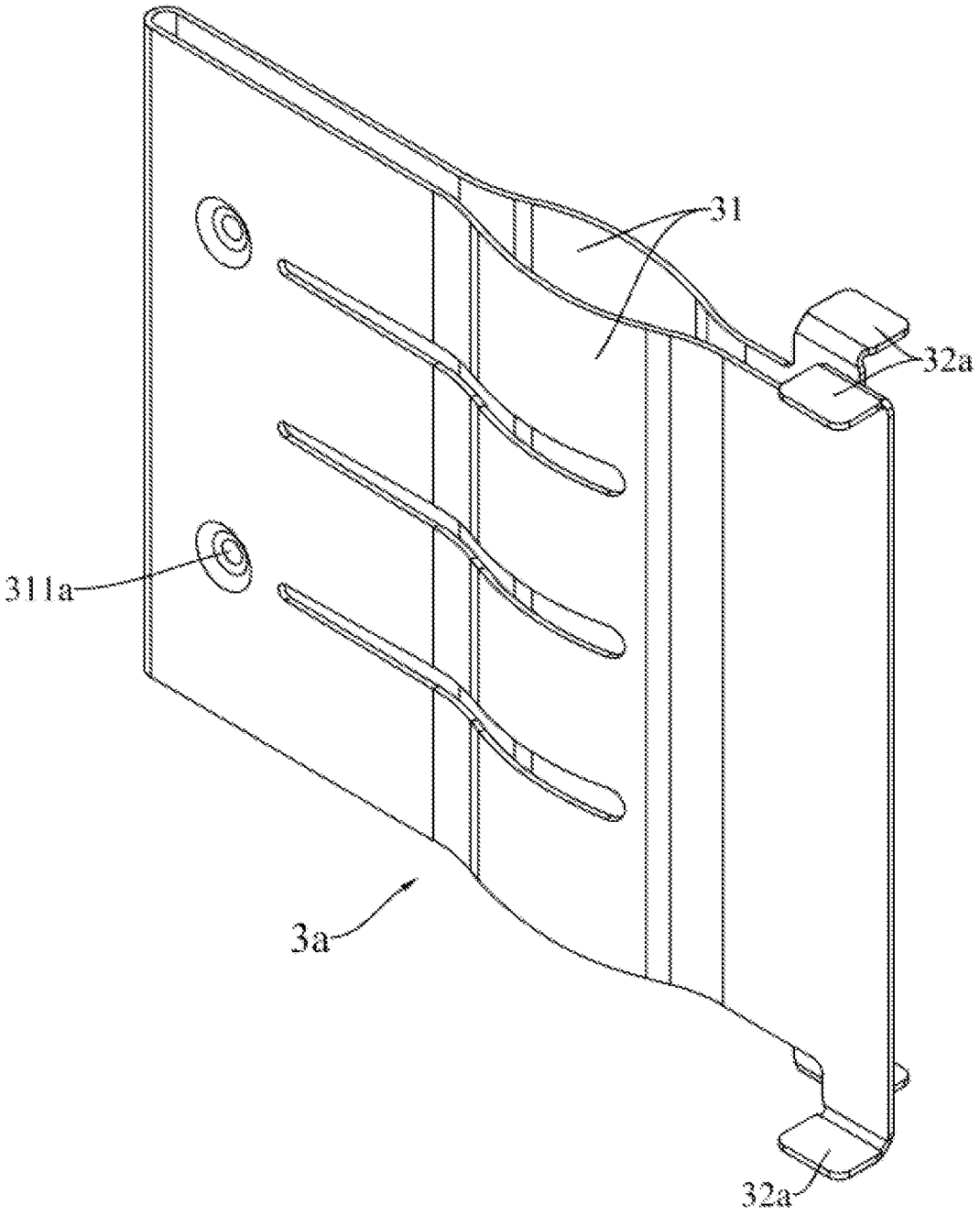
FIG. 3 is a perspective view of a first anti-electromagnetic-interference elastic sheet of the shield according to the embodiment of the disclosure.
Figure 7:
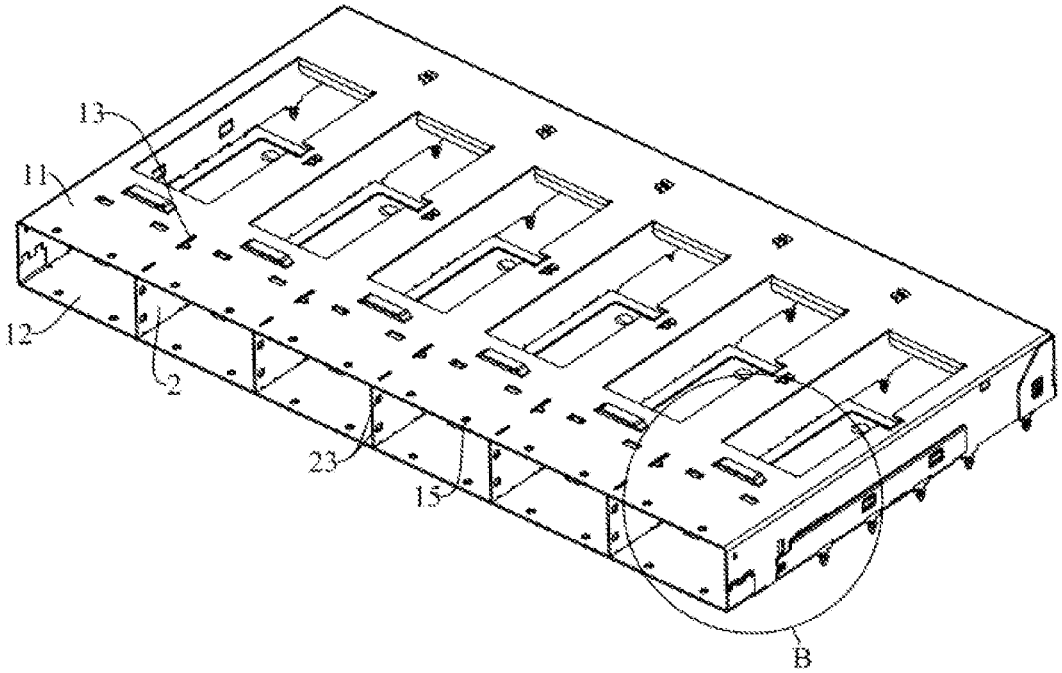
FIG. 7 is a perspective view of the shell and divider plates of the shield according to the embodiment of the disclosure.
Figure 8:
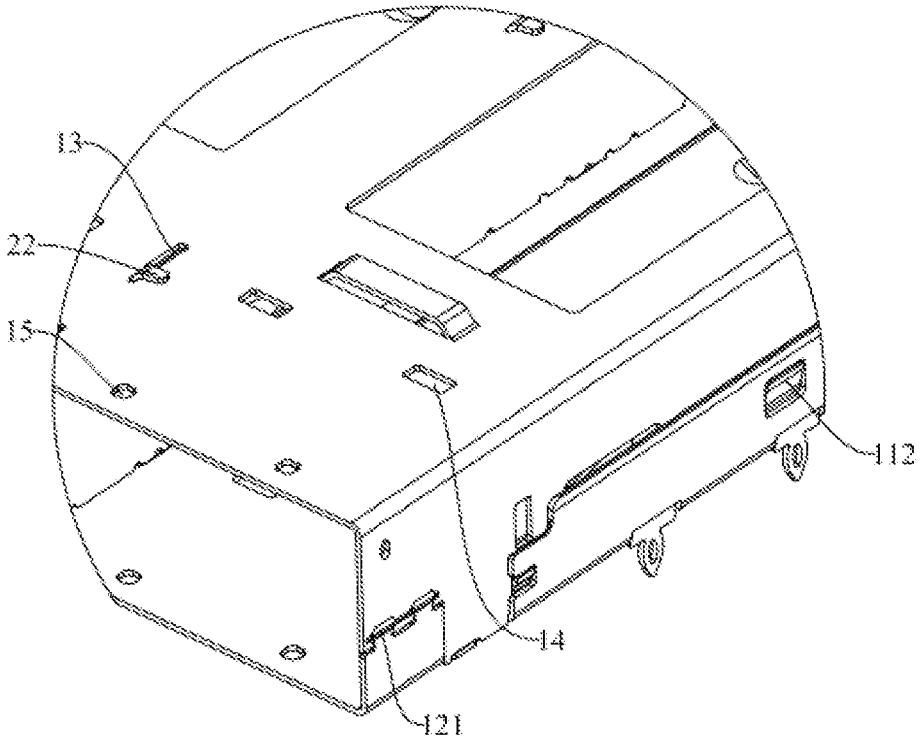
FIG. 8 is an enlarged view of part B of FIG. 7.

To improve the reliability of the connection through the first anti-electromagnetic-interference elastic sheets 3*a*, referring to FIGS. 3 and 7, each one of the two metal sheets 31 of each first anti-electromagnetic-interference elastic sheet 3*a* is provided with first protrusions 311*a* spaced apart. Each of the divider plates 2 is provided with a first positioning hole 23. Each of the first protrusions 311*a* sticks at a respective one of the first positioning holes 23. Optionally, each of the two metal sheets 31 of each of the first anti-electromagnetic-interference elastic sheets 3*a* is provided with a first protrusion 311*a*. The first protrusions 311*a* are arranged at opposite positions of the two metal sheets 31, and the two first protrusions 311*a* opposite to each other stick at the same first positioning hole 23. Alternatively, the first protrusions 311*a* of the two metal sheets 31 of each of the first anti-electromagnetic-interference elastic sheets 3*a* are provided at staggered positions of the two metal sheets 31. Alternatively, the first protrusion 311*a* is disposed on only one of the metal sheets 31 of each of the first anti-electromagnetic-interference elastic sheets 3*a*.

Referring to FIG. 2, a ledge 33*b* extends from a side of each the second positioning sheets 32*b* in a direction perpendicular to a direction in which the second positioning sheets 32*b* extend. Optionally, the width of the ledge 33*b* ranges from one-third to one-second of the width of the second positioning sheet 32*b*. For example, the width of the ledge 33*b* may be one-third, or seven-eighteenths, or four-ninths, or one-second of the width of the second positioning sheets 32*b* so that the ledge 33*b* with the width is capable of withstanding a larger bending moment. When the second anti-electromagnetic-interference elastic sheets 3*b* are mounted on the shell 1, the second anti-electromagnetic-interference elastic sheets 3*b* are moved to abut against adjacent two sides of the second limit hole 14. When the second positioning sheet 32*b* abuts against the side of the second limit hole 14 in the direction toward the side where the ledge 33*b* is disposed, the second positioning sheet 32*b* is riveted. The ledges 33*b* are disposed to prevent the second positioning sheets 32*b* to come out of the second limit holes 14 so that the reliability of the connection of the second anti-electromagnetic-interference elastic sheets 3*b* is improved.

To improve the reliability of the connection of the second anti-electromagnetic-interference elastic sheet 3*b*, referring to FIGS. 6 to 9, each one of the two metal sheets 31 of each second anti-electromagnetic-interference elastic sheet 3*b* is provided with second protrusions 311*b* spaced apart and protruding toward the other one of the two metal sheets 31 of the same one of the second anti-electromagnetic-interference elastic sheets 3*b*. The walls of the shells 1 are provided with second positioning holes 15, and each of the second protrusions 311*b* sticks at a respective one of the second positioning holes 15. Optionally, each of the two metal sheets 31 of each of the second anti-electromagnetic-interference elastic sheets 3*b* is provided with a second protrusion 311*b*. The second protrusions 311*b* are arranged at opposite positions of the two metal sheets 31, and the two second protrusions 311*b* opposite to each other stick at the same second positioning hole 15. Alternatively, the second protrusions 311*b* of the two metal sheets 31 of each of the second anti-electromagnetic-interference elastic sheets 3*b* are provided at staggered positions of the two metal sheets 31. Alternatively, the second protrusion 311*b* is disposed on only one of the metal sheets 31 of each of the second anti-electromagnetic-interference elastic sheets 3*b*.

For ease of mounting the second anti-electromagnetic-interference elastic sheet 3*b*, the second positioning sheet 32*b* extends from the metal sheet 31 of the second anti-electromagnetic-interference elastic sheet 3*b* in the shell 1. The second positioning sheet 32*b* is guided through the second limit hole 14 from the inside of the shell 1 to the outside of the shell 1. The second positioning sheet 32*b* can be riveted from the outer side of the shell 1 to abut against the outer wall of the shell 1 so that it is convenient to mount the second anti-electromagnetic-interference elastic sheet 3*b*.

Referring to FIGS. 4, 7, 9 and 10, the upper end and the lower end of each of the divider plates 2 are connected to third positioning sheets 22. The top wall and the bottom wall of the shell 1 are provided with third positioning holes 16. Each of the third positioning sheets 22 are guided through a respective one of the third positioning holes 16 and abuts against an outer wall of the shell 1. Optionally, the third positioning hole 16 is a notch disposed on the inner wall of the first limit hole 13. The positional relationship between the third positioning hole 16 and the first limit hole 13 may be other positional relationships. For example, the third positioning hole 16 and the limit hole 13 may be spaced apart. The third positioning sheet 22 and the third positioning hole 16 cooperate such that the divider plate 2 is mounted in the shell 1 so that the divider plate 2 can be mounted conveniently. In detail, a plurality of the third positioning sheets 22 are provided, the third positioning sheets 22 are arranged in the longitudinal direction of the divider plate 2 so that the reliability of the connection of the divider plate 2 is improved. In an embodiment, the width of the third positioning sheet 22 increasingly decreases in the direction away from the divider plate 2 so that friction between the third positioning sheet 22 and the outer wall of the shell 1 is increased, and the third positioning sheet 22 is reliably connected to the outer wall of the shell 1.

Figure 4:
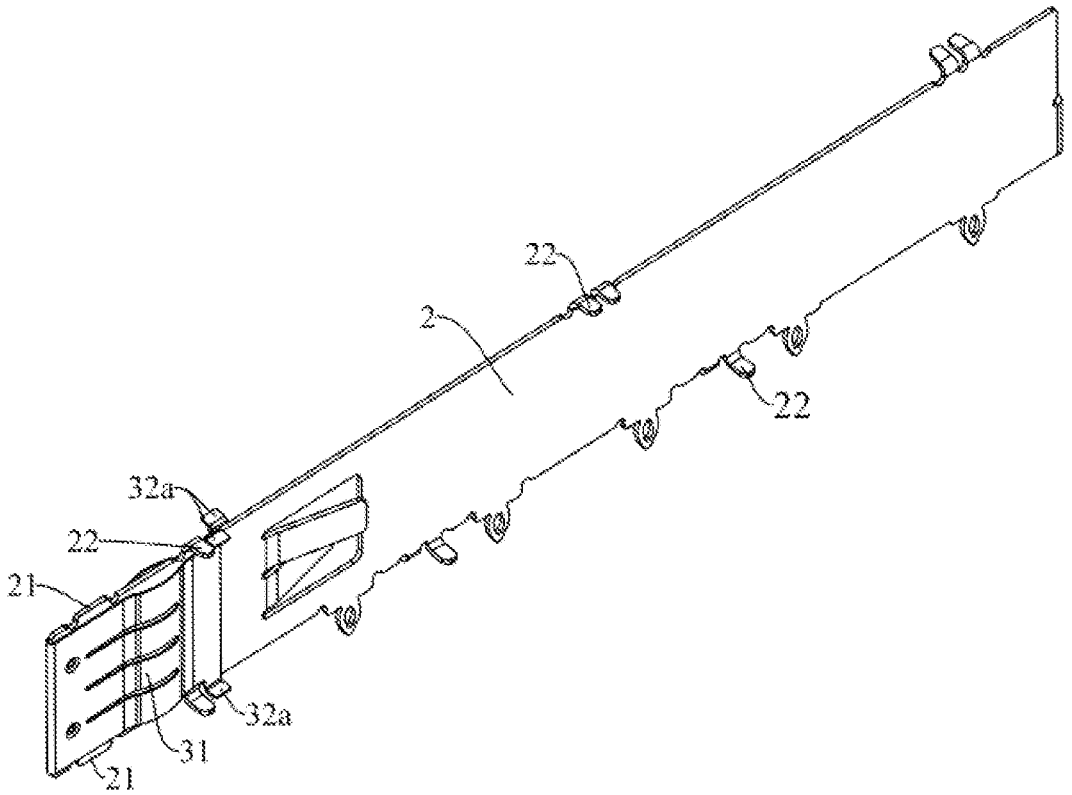
FIG. 4 is a perspective view of a divider plate and a first anti-electromagnetic-interference elastic sheet according to the embodiment of the disclosure.
Figure 5:
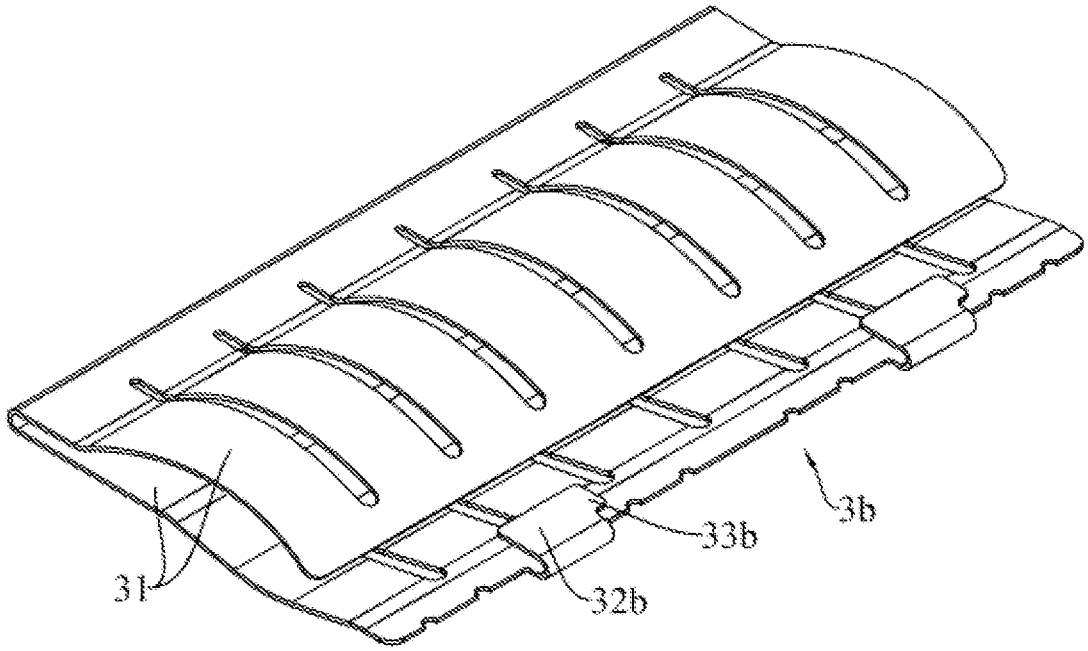
FIG. 5 is a perspective view of a second anti-electromagnetic-interference elastic sheet of the shield according to the embodiment of the disclosure.
Figure 6:
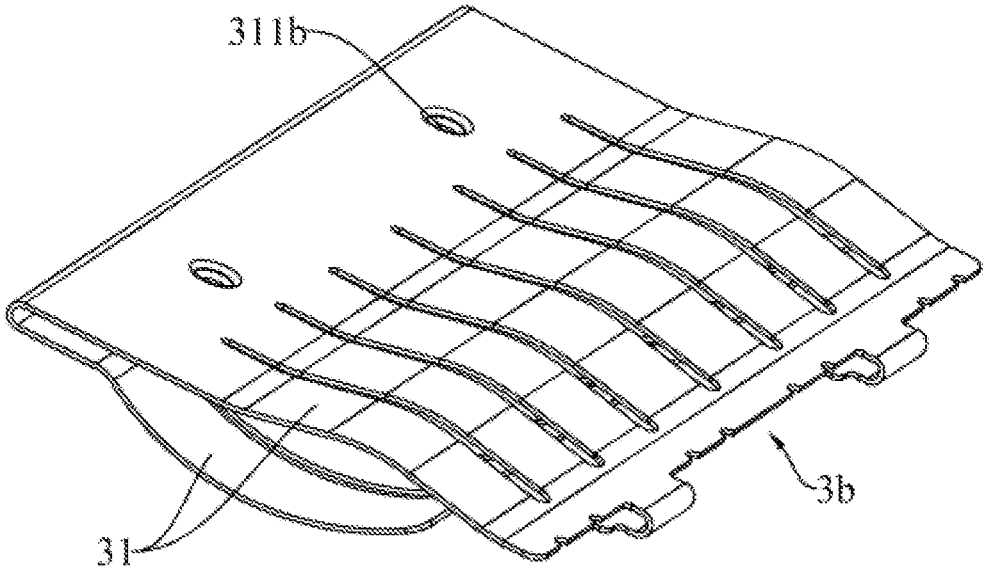
FIG. 6 is a schematic view taken at another angle to illustrate a second anti-electromagnetic-interference elastic sheet of the shield according to the embodiment of the disclosure.
Figure 9:
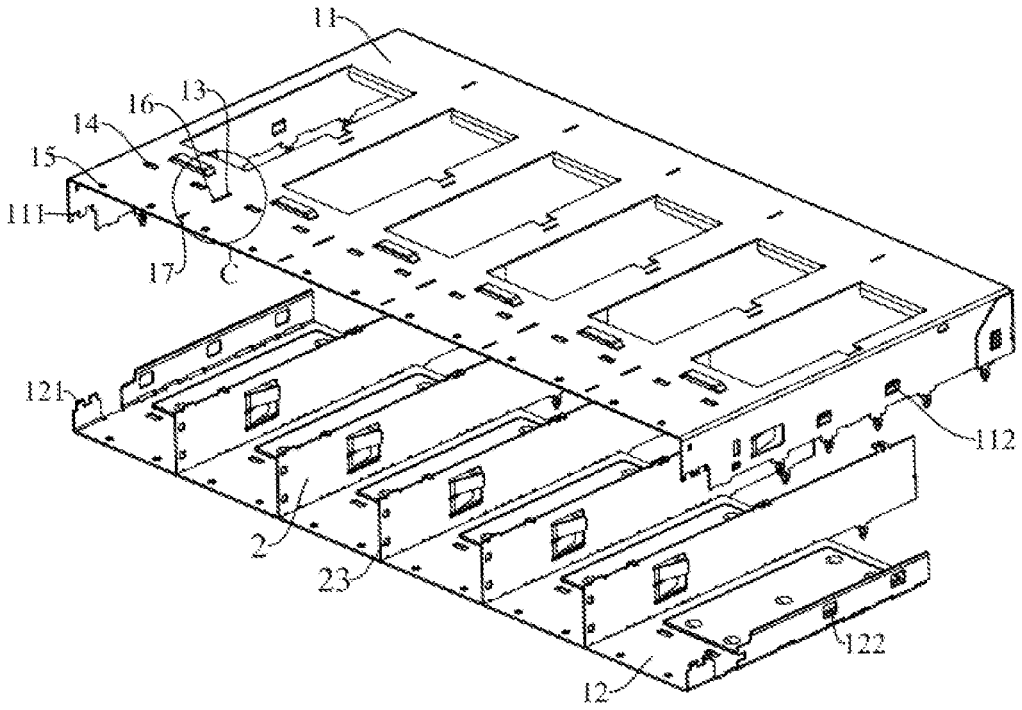
FIG. 9 is an exploded view of the shell and divider plates of the shield according to the embodiment of the disclosure.
Figure 10:
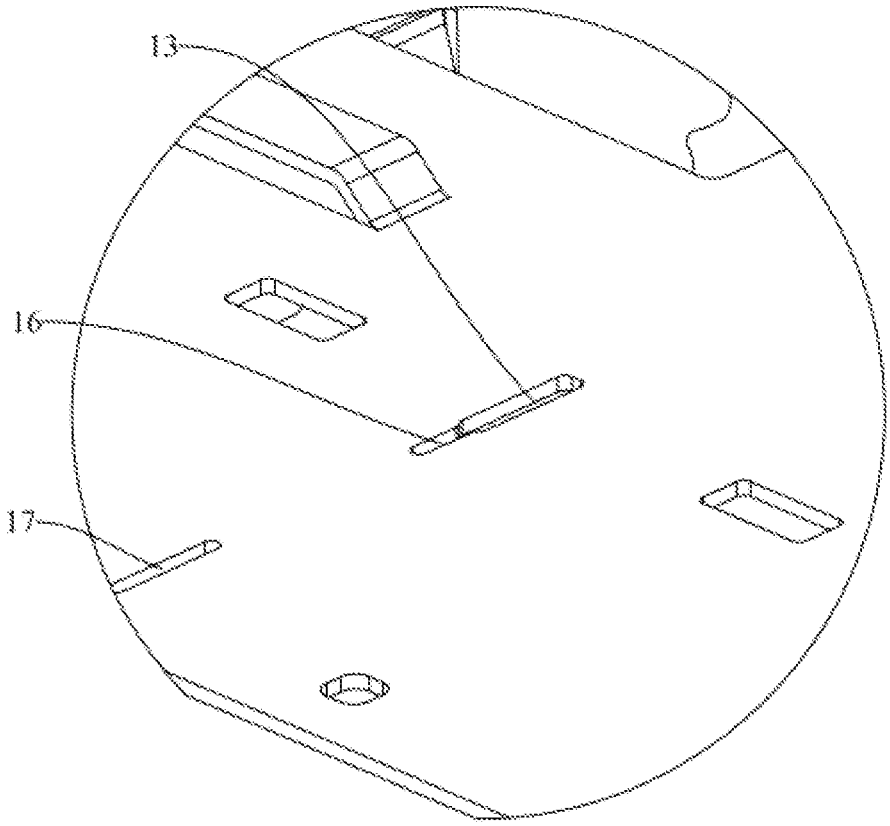
FIG. 10 is an enlarged view of part C of FIG. 9.

Referring to FIGS. 4, 7 and 9, first latching protrusions 21 are connected to the upper end and the lower end of each of the divider plates 2 respectively. The top wall and the bottom wall of the shell 1 are provided with first latching holes 17. Each of the first latching protrusions 21 sticks at a respective one of the first latching holes 17. The first latching protrusions 21 and the first latching holes 17 cooperate to prevent the divider plates 2 from moving in the longitudinal direction of the shell 1 so that the connections between the divider plates 2 and the shell 1 is stable.

For ease of processing the shell 1 and mounting the divider plates 2 and the anti-electromagnetic-interference elastic sheets 3, referring to FIG. 9, the shell 1 includes an upper shell 11 and a lower shell 12. The upper shell 11 and the lower shell 12 are each U-shaped. Each of two sides of the upper shell 11 is detachably connected to a respective one of two sides of the lower shell 12.

Optionally, referring to FIG. 9, of two end faces connected to each other on the upper shell 11 and the lower shell 12, one end face is provided with a block 121, and the other end face is provided with a snap slot 111. The block 121 sticks at the snap slot 111. The cross-sectional area of the bottom of the snap slot 111 is greater than the cross-sectional area of the end farther from the bottom of the snap slot 111. The block 121 cooperates with the snap slot 111 so that the upper shell 11 and the lower shell 12 are connected to each other more securely.

To improve the stability of the connection between the upper shell 11 and the lower shell 12, referring to FIG. 9, the one end of the two side walls of the upper shell 11 farther from the block 121 snap between the two side walls of the lower shell 12. The outer sides of the two side walls of the upper shell 11 are provided with snaps 112. Engagement holes 122 are disposed at positions of the lower shell 12 corresponding to the snaps 112. Each of the snaps 112 sticks at a respective one of the engagement holes 122.

In the embodiment, the first anti-electromagnetic-interference elastic sheets 3*a* are mounted on the divider plates 2, and then the first positioning sheets 32*a* are riveted to abut against the walls of the shell 1. After the second anti-electromagnetic-interference elastic sheets 3*b* are mounted on the shell 1, the second anti-electromagnetic-interference elastic sheets 3*b* are moved so that the ledges 33*b* are staggered in the second limit holes 14, and then the second positioning sheets 32*b* are riveted to abut against the walls of the shell 1. The first positioning sheets 32*a* and the second positioning sheets 32*b* are disposed to enable the anti-electromagnetic-interference elastic sheets 3 to be stably secured to the divider plates 2 or the shell 1 so that the shielding effect of the shield is ensured and the capability of the connector to resist signal interference is improved.

In the disclosure, each first positioning sheet is guided through a respective first limit hole and abuts against a wall of the shell, and the first positioning sheets at the same end of each first anti-electromagnetic-interference elastic sheet are spaced apart and extend in opposite directions so that the first positioning sheets are prevented from coming out of the first limit holes, the first anti-electromagnetic-interference elastic sheets can be prevented from falling off, and the reliability of the connection of the first anti-electromagnetic-interference elastic sheets are improved. Moreover, the second positioning sheet of each second anti-electromagnetic-interference elastic sheet is guided through a respective second limit hole and abuts against a wall of the shell so that the second anti-electromagnetic-interference elastic sheets are prevented from falling off, and the reliability of the connection of each second anti-electromagnetic-interference elastic sheet is improved.

In the disclosure, the connector includes the preceding shield and the anti-electromagnetic-interference elastic sheets can be reliably secured to the shell or the divider plate, thereby ensuring the shielding effect of the shield and improving the capability of the connector to resist signal interference.

What is claimed is:

1. A shield comprising a shell, a divider plate and anti-electromagnetic-interference elastic sheets, wherein the divider plate is disposed in the shell, an upper end and a lower end of the divider plate are connected to a top wall and a bottom wall of the shell respectively, inner walls of the divider plate and inner walls of the shell form a plurality of ports, each of four walls of each of the plurality of the ports is provided with a respective one of the anti-electromagnetic-interference elastic sheets, and each of the anti-electromagnetic-interference elastic sheets comprises two metal sheets that are opposite to each other and that are connected to each other at one end of the two metal sheets;

anti-electromagnetic-interference elastic sheets on the divider plate are first anti-electromagnetic-interference elastic sheets, first limit holes are disposed on the top wall and the bottom wall of the shell, a plurality of first positioning sheets extend from each of an upper end and a lower end of each of metal sheets of each of the first anti-electromagnetic-interference elastic sheets, each of the plurality of the first positioning sheets is guided through a respective one of the first limit holes and abuts against a respective one of walls of the shell, and first positioning sheets at a same end of each of the first anti-electromagnetic-interference elastic sheets are spaced apart and extend in opposite directions; and anti-electromagnetic-interference elastic sheets disposed on the walls of the shell are second anti-electromagnetic-interference elastic sheets, a second positioning sheet extends from one of two metal sheets of each of the second anti-electromagnetic-interference elastic sheets, second limit holes are disposed on the walls of the shell, and each of the second positioning sheets is guided through a respective one of the second limit holes and abuts against a respective one of the walls of the shell.

2. The shield of claim 1, wherein the first positioning sheets at the same end of each of the first anti-electromagnetic-interference elastic sheets are staggered.

3. The shield of claim 1, wherein a ledge extends from a side of each of the second positioning sheets in a direction perpendicular to a direction in which the second positioning sheets extend.

4. The shield of claim 1, wherein of the two metal sheets of each of the first anti-electromagnetic-interference elastic sheets, at least one metal sheet is provided with a first protrusion protruding toward the other metal sheet, the divider plate is provided with a first positioning hole, and each of first protrusions sticks at the first positioning hole.

5. The shield of claim 1, wherein of the two metal sheets of each of the second anti-electromagnetic-interference elastic sheets, at least one metal sheet is provided with a second protrusion protruding toward the other metal sheet, the walls of the shells are provided with second positioning holes, and each of second protrusions sticks at a respective one of the second positioning holes.

6. The shield of claim 1, wherein of metal sheets (31) in the shell (1), the second positioning sheet (32*b*) extends from each metal sheet (31) of the second anti-electromagnetic-interference elastic sheets (3*b*).

7. The shield of claim 1, wherein the upper end and the lower end of the divider plate are each connected to a third positioning sheet, the top wall and the bottom wall of the shell are provided with third positioning holes, and each of the third positioning sheets are guided through a respective one of the third positioning holes and abuts against an outer wall of the shell.

8. The shield of claim 1, wherein the upper end and the lower end of the divider plate are each connected to a first latching protrusion, the top wall and the bottom wall of the shell are provided with first latching holes, and each of first latching protrusions sticks at a respective one of the first latching holes.

9. The shield of claim 1, wherein the shell comprises an upper shell and a lower shell, wherein the upper shell and the lower shell are each U-shaped, and each of two sides of the upper shell is detachably connected to a respective one of two sides of the lower shell.

10. The shield of claim 9, wherein of two end faces connected to each other on the upper shell and the lower shell, one end face is provided with a block, and the other end face is provided with a snap slot; the block sticks at the snap slot, and a cross-sectional area of a bottom of the snap slot is greater than a cross-sectional area of an end farther from the bottom of the snap slot.

11. The shield of claim 10, wherein one end of two side walls of the upper shell farther from the block snap between two side walls of the lower shell, outer sides of the two side walls of the upper shell are provided with snaps, engagement holes are disposed at positions of the lower shell corresponding to the snaps, and each of the snaps sticks at a respective one of the engagement holes.

12. A connector comprising the shield of claim 1.

13. The connector of claim 12, wherein the first positioning sheets at the same end of each of the first anti-electromagnetic-interference elastic sheets are staggered.

14. The connector of claim 12, wherein a ledge extends from a side of each of the second positioning sheets in a direction perpendicular to a direction in which the second positioning sheets extend.

15. The connector of claim 12, wherein of the two metal sheets of each of the first anti-electromagnetic-interference elastic sheets, at least one metal sheet is provided with a first protrusion protruding toward the other metal sheet, the divider plate is provided with a first positioning hole, and each of first protrusions sticks at the first positioning hole.

16. The connector of claim 12, wherein of the two metal sheets of each of the second anti-electromagnetic-interference elastic sheets, at least one metal sheet is provided with a second protrusion protruding toward the other metal sheet, the walls of the shells are provided with second positioning holes, and each of second protrusions sticks at a respective one of the second positioning holes.

17. The connector of claim 12, wherein the second positioning sheet extends from one of the two metal sheets of each of the second anti-electromagnetic-interference elastic sheets in the shell.

18. The connector of claim 12, wherein the upper end and the lower end of the divider plate are each connected to a third positioning sheet, the top wall and the bottom wall of the shell are provided with third positioning holes, and each of the third positioning sheets are guided through a respective one of the third positioning holes and abuts against an outer wall of the shell.

19. The connector of claim 12, wherein the upper end and the lower end of the divider plate are each connected to a first latching protrusion, the top wall and the bottom wall of the shell are provided with first latching holes, and each of first latching protrusions sticks at a respective one of the first latching holes.

20. The connector of claim 12, wherein the shell comprises an upper shell and a lower shell, wherein the upper shell and the lower shell are each U-shaped, and each of two sides of the upper shell is detachably connected to a respective one of two sides of the lower shell.

* * * * *